United States Patent [19]

Pemberton

[11] 4,079,243

[45] Mar. 14, 1978

[54] BATTERY POWERED LAMP ASSEMBLY

[75] Inventor: Whitley Pemberton, Stoughton, Wis.

[73] Assignee: ESB Incorporated, Philadelphia, Pa.

[21] Appl. No.: 735,262

[22] Filed: Oct. 26, 1976

[51] Int. Cl.[2] ..... F21S 9/02

[52] U.S. Cl. ..... 240/10.6 R; 362/200; 362/191

[58] Field of Search ..... 240/10.6, 10.65, 73 R

[56] References Cited

U.S. PATENT DOCUMENTS

| | | | |
|---|---|---|---|
| 3,274,382 | 9/1966 | Fattori | 240/10.6 R |
| 3,588,490 | 6/1971 | Nicholl | 240/10.6 R |
| 3,757,107 | 9/1973 | Peasley | 240/10.6 R |

*Primary Examiner*—William H. Beha, Jr.
*Attorney, Agent, or Firm*—Gilbert W. Rudman; Anthony J. Rossi; Gary V. Pack

[57] ABSTRACT

A light fixture of the type enclosing a plurality of standard dry cells. An outer, support member forms an outer housing to be affixed to a wall, ceiling or other fixed object. The outer housing receives an inner housing comprising a unitary battery enclosure, reflector and lamp socket receptacle. A sheet of resilient foam material disposed between the outer and inner housings is compressed upon assembly of the two members and urges them apart to aid in separating the members when latches are released. A dome-shaped lens attaches to the inner housing to protect the lamp and to diffuse the light which it produces.

The enclosures for the batteries which are formed by the inner housing are provided with partitions separating the batteries, and upstanding bosses about certain of the contacts therefor, to prevent completion of an electrical circuit should any of the cells be reversed during installation.

20 Claims, 3 Drawing Figures

BATTERY POWERED LAMP ASSEMBLY

BACKGROUND OF THE INVENTION

The present invention relates to self-contained light fixtures, and more particularly to an improved light fixture enclosing a plurality of batteries for energizing a lamp disposed within the fixture.

Although most lighting fixtures presently in use are intended to be coupled to a distant source of electrical power through appropriate wiring, in some cases it is desirable that a lighting fixture be entirely self-contained. The applications for such fixtures are many, their ease of installation allowing them to be placed in areas where it would be expensive, impractical, or dangerous to install a conventional wired fixture. Such applications conventionally include barns, sheds and attics but they may also comprehend closets, stairwells and the like wherein the need for a fixture is not such as to justify the expense of the necessary wiring. Still further, self-contained fixtures find great utility in providing emergency lighting for occupied areas when power lines are disabled due to fire, storms, accidents and the like. A self-contained lighting fixture is also extremely useful in campers, trailers and similar environments where conventional wired power is not available.

In principle, the provision of a self-contained fixture is quite simple. An ordinary flashlight, electric lantern or the like can be used as an emergency power source and in fact such portable lamps often include brackets or hangers which allow them to be attached to a wall or other stationary base so that they may serve as temporary lighting fixtures. However, the need has persisted for an economical, attractive lighting fixture which is compact in design and rugged enough to stand continuous service, but is economical to manufacture.

Several types of self-contained fixtures have been designed. In U.S. Pat. Nos. 3,274,382—Fattori and 3,757,107—Peasley, for example, self-contained battery powered fixtures are proposed. Further, in U.S. Pat. Nos. 1,913,696—Wiley et al and British Patent 468,371—Webber other, similar types of battery-containing are shown. All of the foregoing designs, however, have shortcomings which have precluded their economical manufacture and/or widespread usage. In particular, in contradistinction to ordinary wired light fixtures it is necessary that battery-containing units be easy to disassemble in order to renew the batteries and lamps periodically. It is also highly desirable that the battery-receiving structures of these devices be adapted to prevent erroneous battery insertion by consumers who may either be unfamiliar with battery powered apparatus or who are acting under stress due to a sudden loss of electrical power or other emergency. Further, inasmuch as such fixtures may be stored for long periods of time before they are needed, it is highly desirable that they be resistant to damage from battery leakage. Accordingly, it will be understood that it would be highly desirable to provide a battery-powered lighting fixture of a simplified design which exhibits none of the shortcomings of previous approaches.

It is therefore an object of the present invention to provide an improved, battery-powered lighting fixture.

It is another object to provide a self-contained lamp assembly which is easy to assemble and disassemble for routine maintenance.

It is another object of the invention to provide a battery-powered lamp assembly which will not afford a completed electrical circuit when one or more batteries are reversed.

Yet another object is to provide a battery-powered lamp fixture which is resistant to leakage of battery fluid.

SUMMARY OF THE INVENTION

Briefly stated, in accordance with one aspect of the invention the foregoing objects are achieved by providing an outer, support housing having a generally planar base and a peripheral shell and an inner housing which is retained within the shell by means of resilient latches. The inner housing comprises one or more enclosures for receiving batteries, each enclosure being formed by a continuous wall upstanding from a planar floor member. The edges of the battery-enclosing wall press against a resilient pad disposed within the support housing to provide a liquid-tight seal, and to afford a bias between the housings. The other side of the floor member constitutes a reflector for a lamp disposed centrally therewithin, and a dome-shaped lens is releasably latched to the floor and extends over the lamp.

In a preferred embodiment the lamp assembly includes a set of bosses and partitions extending within the battery enclosure to prevent the completion of an electrical circuit should one or more of the batteries be placed in a reversed position. A pair of double ended keyhole-shaped openings a provided in the base to allow either temporary or permanent mounting of the base to a support member.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

Figure 1:
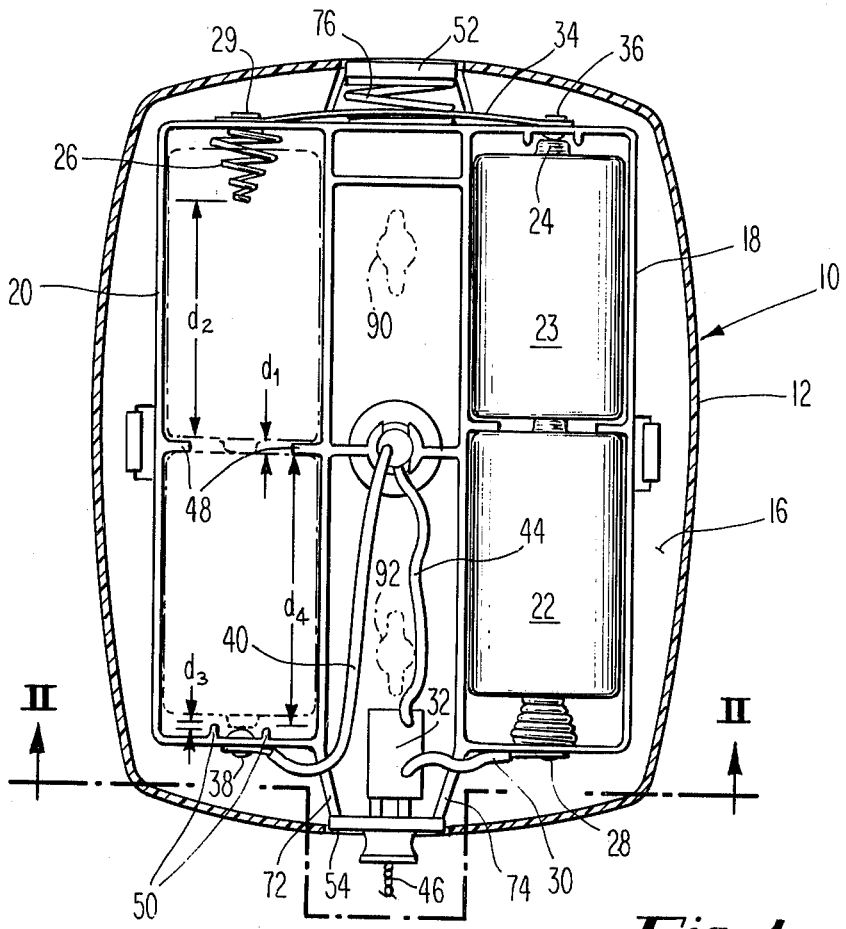
FIG. 1 is a partly sectioned plan view of the inventive lamp assembly.
Figure 2:
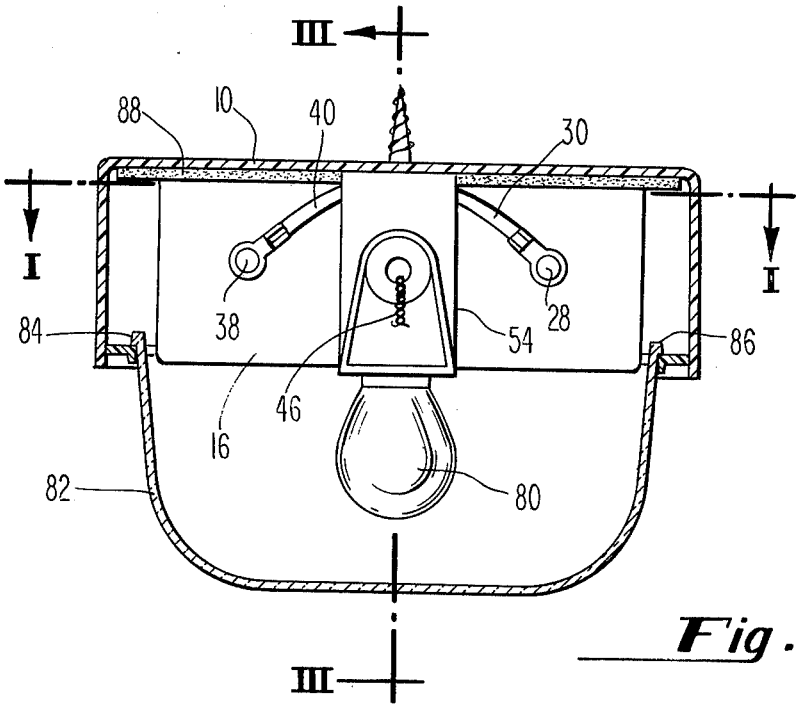
FIG. 2 is a partly sectioned end view taken at II—II of FIG. 1.
Figure 3:
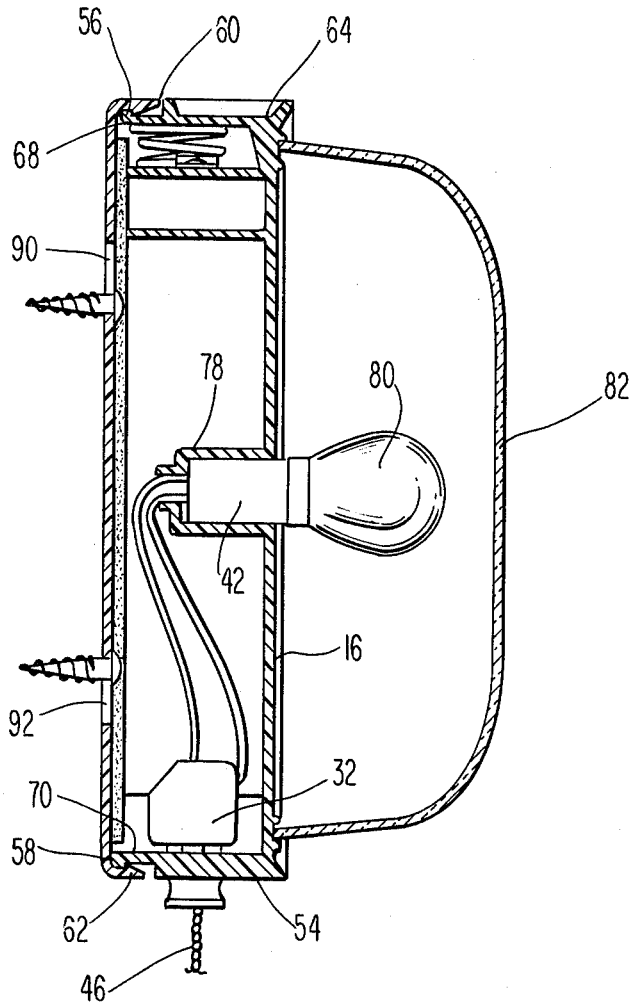
FIG. 3 is a partly sectioned view taken at III—III of FIG. 2.

FIGS. 1 – 3 illustrates the construction of the inventive lamp assembly, showing details of the inner portions thereof. The planar base member of an outer support housing, generally designated 10, has been cut away in FIG. 1 to leave the peripheral shell 12 which arises therefrom. The peripheral shell encases an inner housing generally designated 14. The inner housing comprises a planar floor or bulkhead 16 which extends substantially across the areas within shell 12 and serves to close the outer support housing. Upstanding from the inner surface of bulkhead 16 are a pair of continuous walls 18, 20 each of which forms a generally rectangular enclosure herein termed a battery box. The enclosures are parallel with one another, and spaced apart as shown to afford a space for other portions of the apparatus. While in the disclosed embodiment each battery box is dimensioned so as to receive a pair of standard dry cells it will be appreciated that the number and size of cells can be varied to suit a given application. A preferred embodiment of the present invention makes use of the common, cylindrical dry cell of the type commonly termed a "flashlight battery" and available in various sizes. Other types of cells having similar characteristics may also be used, with appropriate modifications to the proportions of the battery boxes.

The type of cell contemplated for use will herein be termed a "standard dry cell" and, as shown in the Figures and familliar to workers in the art, comprises a generally cylindrical body including a planar lower end surface or base, and a generally planar upper surface having a terminal 24 upstanding at or near the center. With such a cell the outer casing, and particularly the exposed lower surface thereof, constitutes a negative electrode or terminal while the upstanding center terminal comprises a positive terminal. By placing the batteries in aligned, end-to-end position as shown a series circuit is produced in which the potentials of the cells additively combine to produce the voltage necessary for operating the device. A resilient spring or the like 26 is provided at one end of each battery box, and coupled by means of a rivet 28 which extends through the wall of the battery box to a conductor for continuing the series circuit. Conductor 30, which thus is coupled to the negative electrode of cell 22, extends to a pull chain switch or the like 32. Corresponding terminal 29 of battery box 20, on the other hand, is coupled by means of a jumper strap 34 to a rivet 36 extending through the uppermost end of battery box 18. The inner end of rivet 36 comprises a fixed contact for the positive terminal 24 of cell 23. In like manner, another rivet 38 at the lowermost end of battery box 20 is coupled to an insulated conductor 40 connected to one terminal of a lamp socket 42. The other terminal of the socket is coupled by way of a conductor 44 to switch 32. Accordingly, when switch 32 is closed by means of pull chain 46 or the like a circuit is completed whereby the cells of the unit are placed in series relationship with a lamp disposed in socket 42.

It is known that in a multi-cell apparatus the reversal of one or more of the cells often leads to detrimental results. Particularly in the case of a three or more cell arrangement, the reversal of one cell causes it to be charged by the remaining cells. Aside from rapidly draining the charge from the various cells this often has a detrimental physical effect on the reversed cell, causing it to swell or to rupture and/or leak, damaging the apparatus.

In the event that the same number of cells oppose one another, their potentials will balance and there will be no potential available for energizing the apparatus. However, if only one of a set of three or more cells is reversed its effect will be overcome by the remaining cells. Frequently, sufficient potential will still exist to light a lamp. Despite the fact that the lamp will not burn as brilliantly as it should a user may not notice the lessened brightness, and will assume that the batteries are properly arranged. The user may then proceed to use the apparatus until the cells, weakened by the reversed connection, are exhausted. If the apparatus is not used the cells will still proceed to exhaust themselves in short order, with the possible result that leakage from the reversed cell will damage the apparatus. For these reasons the present inventor hs provided means for positively preventing the establishment of a series circuit in the event that one or more cells are reversed.

Returning to the structure of the battery boxes, it will be seen that each box is provided with a partition midway along its length. In the preferred embodiment the partition 48 comprises a pair of opposed, inwardly directed members which extend between the axially-aligned cells. The dimension $d_1$, which represents the thickness of the partition, is less than the height of center terminal 24 of the cells so that the center terminal of the uppermost cell in box 20 can extend through the partition and make contact with the planar bottom end of the lowermost cell in the box. Further, dimension $d_2$ between the free end of contact 26 and the nearest surface of the partition is less than the height of the body of a cell. In this manner when a cell is inserted in the upper half of the battery box 20, contact 26 is compressed and urges the cell downwardly against the partition.

While the various partitions may be comprised of inwardy-directed wall segments as shown, it will be recognized that the opening in the partition need only be large enough to receive the center terminal of the cell so that it may protrude through the partition and make contact with the other cell in the battery box. Accordingly, a solid partition having a small aperture, or more advantageously a deep notch, will also have to separate the cells in the manner intended while allowing the center terminals to protrude therethrough.

In functional cooperation with partition 48 is a boss 50 upstanding frm the end wall of battery box 20 alongside stationary contact 38. The height $d_3$ by which boss 50 extends above the surface of the stationary contact must be no greater than the height of center terminal 24, so that the center terminal can extend within the boss and make electrical contact with contact 38. If the boss is too high it will abut the upper surface of the cell and keep the center terminal from touching contact 38. The boss must, however, be somewhat higher than the stationary contact so as to prevent the flat cylindrical end of a reversed cell from touching the contact.

In a preferred embodiment boss 50 actually comprises a pair of parallel ribs extending vertically into the plane of the figure. However, other configurations such as a semicircle or a group of upstanding projections may be utilized so long as they exhibit the dimensions indicated. Finally the dimension $d_4$, between the edge of the boss and the confronting surface of partition 48, must be greater than the height of the cylindrical body of a standard cell in order to allow the cell to be placed in the lower half of the partitioned battery box.

The partition 48 and upstanding abutment 50 cooperated to prevent the completion of an electrical circuit in the event that either or both of the cells is installed in a reversed position. If, for example, the cell in the uppermost portion of battery box 20 is inverted its center terminal will make electrical contact with resilient contact 26. However, owing to the presence of partition 48 the planar, the lower end of the cell will be spaced from the confronting, planar end of the cell in the other portion of the battery box. The gap which is formed by the partition prevents the cells from contacting one another, thus preventing the establishment of an electrical circuit.

A pair of upstanding tabs 52 and 54 are integral with, and arise from, bulkhead 16. As shown in FIG. 3, the distal ends 56, 58 of the tabs comprise latching means which are received by complementary latching abutments 60 and 62 respectively, formed in the outer support housing. The tabs each include a thick, generally planar body with a thin, elongate tongue section 68, 70.

A notch or aperture is provided in the opposed ends of shell 12 which conforms to the thickened sections and receives them, while the tongue portions 68, 70 extend upwardly within the shell to engage latching abutments 60 and 62. One or both of the tabs can then easily be deflected inwardly by exerting manual pressure upon the thick body sections which protrude through the sidewall notches. In one successfully tested embodiment tab 54 was reinforced with fillets 72, 74 which added substantial rigidity to the tab. However, opposing tab 52 nonetheless exhibits sufficient resiliency so that it can be deflected far enough to allow both of the latching tabs to be freed from the complementary engaging members within wall 12. If needed, additional bias can be provided to tab 58 by means of a spring 76. Spring 76 is held in place by jumper strip 34 which extends between the coils of the spring in the manner shown in FIG. 1.

The rigidified tab 54 provides a mounting for switch 32, and further comprises a convenient location for the actuating member of the switch, such as pull chain 46. When placed in this position, the body of the switch lies between parallel battery boxes 18, 20 and thus allows for an increased compactness of design.

A cylindrical member 78 formed integrally with the inner casing is provided and connected by strengthening ribs to the adjacent battery boxes 18 and 20. The member receives a socket 42 in which lamp 80 is mounted, thus allowing the filament of the lamp to be brought closer to the plane of bulkhead 16 and lessening the overall height of the lamp assembly. The outer surface of bulkhead 16 is of a light color to provide good reflection, and in a preferred embodiment is stippled to aid in diffusing the illumination from the lamp. A lens 82 of a clear plastic or the like is coupled directly to the inner housing of the lamp assembly by means of a pair of opposed latches 84, 86 which extend through apertures on opposite sides of bulkhead 16. Preferably the sides of lens 82 are frosted, with the central section thereof being clear to aid in diffusing and directing the illumination from lamp 80 in a desired manner.

In a presently preferred embodiment the illustrated inner and outer housings and lens are formed of appropriate commercially-available plastics via the injection molding process. The outer support housing may be made from ABS, a commonly available modified styrene plastic which exhibits high impact strength. The inner housing may be formed of talc-filled polypropylene which exhibits the necessary resiliency, and moreover is substantially heat resistant.

A layer of resilient material 88 such as a closed-cell plastic foam is attached to the inner surface of base 10. The uncompressed thickness of the foam layer is greater than the clearance between the uppermost edges of battery boxes 18, 20 and base 10 so that it is compressed by the battery box edges when the inner and outer housings are assembled and the latches engaged. In this manner the resilient foam layer provides two functions.

Firstly, it acts as a spring member to mechanically bias the inner and outer housings apart. This is of considerable importance in facilitating the separation of the inner and outer housings, particularly when the outer housing is affixed to a ceiling or wall inasmuch as in this situation the entire assembly cannot be manipulated. In most applications it is anticipated that the lamp assembly will be disposed in an elevated position where it is awkward to reach or manipulate elements of the assembly. By biasing the inner and outer housings apart ease in disassembly is achieved since one need only apply pressure to one or both of the latching tabs 52, 54 in order to cause the assembly to spring apart. It is then unnecessary for a user to simultaneously apply pressure to the opposite ends of the lamp assembly and pull the housing outward, in order to separate the elements.

Secondly, the resilient layer 88 provides a seal which prevents liquid from a leaking cell from finding its way out of a box containing the cell and corroding internal components of the lamp assembly, or even worse, escaping from the assembly and injuring the surface upon which the lamp is mounted. This is of particular importance where the lamp is mounted to a vertical surface such as a wall, in which case escaping fluid may run down the wall and do considerable damage.

Still another important aspect of the present invention inheres in the configuration of the mounting holes 90, 92 which extend through the base of the outer casing. The configuration of the holes is shown in phantom form in FIG. 1 and comprises a departure from the commonly-used "keyhole" configuration. As is well known to those skilled in the art, the usual "keyhole" configuration comprises an aperture with an enlarged section at one end, whose diameter is sufficient to receive the head of a screw. The opposite end of the hole is considerably narrower, and is just wide enough to receive the shank of the screw but not large enough to allow the head to pass through. A pair of screws, usually of the round head type, are screwed into a mounting surface and spaced apart by a dimension equal to the spacing of the holes; the article to be mounted is slipped over the screws by allowing the heads of the screws to pass through the enlarged section of the keyhole-shaped holes. The article is then moved transversely with respect to the screws so that they slide into the narrow portion of the slots. This affords temporary mounting inasmuch as the article can easily be removed by sliding it back to its initial position and lifting it off the screws. It will be noted, however, that it is impossible to permanently mount such an apparatus to a surface owing to the fact that no matter how one positions the scews it will always be possible to slide the apparatus in such a manner as to free it from beneath the screw heads.

The mounting holes contemplated by the present invention, however, afford the latter possibility. In particular, each of the openings comprise what may be considered to be a double-ended keyhole, or alternatively an elongate slot having an enlarged center section. By spacing a pair of screws a distance corresponding to the separation of the enlarged portion of the mounting holes 90, 92 they can be slipped through the enlarged openings, and the apparatus moved in one direction or the other so that the screws then rest in the narrowed portion of the slots. The apparatus can easily be removed in the conventional manner by sliding it transversely until the screws once more line up with the enlarged section of the slots. If, however, it is desired to mount the apparatus permanently, the screws are inserted through opposite portions of the narrowed slots. The screws will then lie in either the ends of the slots which are nearest to, or furthest from, one another so that one or the other screw will always oppose translation of the apparatus. As the apparatus can no longer be slid transversely beneath the screw heads, it will be appreciated that inadvertent removal or loosening of the apparatus from its mounting is impossible.

The above-described construction gives rise to numerous advantages not found in prior art structures.

The lamp assembly of the present invention while formed in three discrete sections, i.e., the outer or support housing; the inner or battery-carrying housing; and the lens, can be selectively separated depending upon whether one wishes to replace a lamp or replace one or more dry cells. In the event that a lamp need be replaced, it is only necessary to squeeze the opposing sides of lens 82 together so that latch members 84, 86 can pass through the apertures in bulkhead 16. It is accordingly unnecessary to disassemble the battery-enclosing inner housing in order to gain access to the lamp for replacement purposes. On the other hand, if it is desired to replace the batteries or for any other reason to remove the inner housing, this can readily be achieved by depressing the opposed latches 52, 54 as explained above. In this event the lens need not be removed from the inner casing, so that the lamp remains protected and is far less likely to be broken should the inner housing slip from the grasp of the user while it is being removed from the outer housing. Of course, it is always possible for a user to disassemble all three elements of the assembly if desired; however, it is contemplated that in most instances it will only be necessary to gain access to either the lamp or the batteries, but not both.

Still further, inasmuch as the outer surface of bulkhead 16 is formed of a light diffusing or reflecting material no separate or separable reflector need be provided. This simplifies and economizes the construction of the unit, and at the same time minimizes the amount of manipulation which is required for removing a lens or replacing a burned out lamp. In addition, the battery-carrying inner housing may be removed from any given permanently-affixed outer housing and installed in another outer housing if need be. In this manner should the mechanism of one lamp assembly be damaged or for any reason become inoperative, the inner housing of another assembly may readily be transferred to the former without unfastening the outer housing from its mounting surface.

As will be evident from the foregoing description, certain aspects of the invention are not limited to the particular details of the examples illustrated, and it is therefore contemplated that other modifications or applications will occur to those skilled in the art. It is accordingly intended that the appended claims shall cover all such modifications and applications as do not depart from the true spirit and scope of the invention.

What is claimed as new and desired to be secured by Letters Patent of the United States is:

1. A lamp assembly including a lamp-receiving socket and a housing for enclosing at least two standard dry cells in series alignment, comprising:

an inner housing including a wall member defining a cell-retaining enclosure including a pair of elongate sidewalls and first and second end walls;

a fixed contact disposed at a first end wall of said enclosure for making electrical connection with the center terminal of one of said standard dry cells;

a boss upstanding from said first end wall adjacent said fixed contact and extending thereabove for preventing the base of a standard dry cell from making electrical connection with said fixed contact;

a resilient contact disposed at a second end of said enclosure for making electrical connection with the base of one of said standard dry cells;

partition means having first and second parallel surfaces and extending inwardly from said wall member generally transversely to said enclosure to divide said enclosure into cell-receiving segments;

said first surface of said partition means being spaced from said resilient contact by a dimension less than the height of the body of the standard dry cell;

said second surface of said partition being spaced from said boss by a dimension greater than the height of the body portion of a standard dry cell, but less than the overall height of a standard dry cell including the center terminal thereof;

the thickness of said partition means being less than the distance by which the center terminal extends above the body of a standard dry cell.

2. A lamp assembly according to claim 1, wherein said assembly further comprises a substantially transparent lens means disposed over said lamp socket for allowing the egress of light developed by a lamp in said socket.

3. A lamp assembly according to claim 2, further including an outer housing for receiving said wall member therein.

4. A lamp assembly according to claim 3, further including a layer of resilient material disposed between said wall member and an inner surface of outer housing, said resilient layer exhibiting an uncompressed thickness greater than the clearance between said wall member and said inner surface of said outer housing for biasedly urging said wall member away from said outer housing.

5. A lamp assembly according to claim 4, further including first and second latch means extending from said inner housing for engaging said outer housing, said latch means comprising a pair of upstanding latching tabs positioned adjacent opposite ends of said cell-retaining enclosure.

6. A lamp assembly according to claim 5, further including switch means coupled to said contacts in said cell-retaining enclosure, and switch actuating means extending through one of said latch means.

7. A lamp assembly according to claim 3, further including a second wall member defining a second cell-retaining enclosure, said enclosures comprising generally parallel, rectangular battery boxes.

8. A lamp assembly according to claim 7, wherein said lamp socket is disposed between said generally parallel battery boxes, said socket having an axis extending generally perpendicularly to the longitudinal axes of said battery boxes.

9. A lamp assembly according to claim 8, wherein said latch means are disposed at either end of the locus between said parallel battery boxes.

10. A lamp assembly according to claim 9, further including a generally planar bulkhead supporting said battery boxes and said latch means; a generally dome-shaped lens disposed on said bulkhead; and second latch means for releasably coupling said generally dome-shaped lens to the side of said generally planar bulkhead opposite said battery boxes.

11. A lamp assembly according to claim 10, wherein said lens comprises a peripheral frosted surface and a generally centrally located transparent surface.

12. A self-contained battery powered lamp assembly comprising:

an outer housing having a generally planar base and an upstanding shell integral with said base and upstanding thereabout;

said shell defining at least two open-ended apertures therein, said shell further defining first latching means extending within said shell and between said apertures and said base;

attachment means formed in said base for attaching said outer housing to a rigid mounting surface;

an inner housing having a generally planar floor member spaced from and extending generally parallel to said base of said outer housing and having first and second opposed surfaces;

first and second latching tabs upstanding from one surface of said planar floor for engaging ones of said apertures and said first latching means;

at least one continuous wall upstanding from the second surface of said planar floor to define an enclosure for receiving at least one battery therein;

electrical contact means extending through said wall for making electrical contact with terminals of the battery;

a lamp socket formed in said inner housing for receiving an electric lamp therein;

switch means coupled in circuit between said lamp socket and said electrical means;

said switch actuating means extending through one of said latching tabs;

second latching means formed integrally with said inner housing; and a lens disposed over said floor of said inner housing and substantially enclosing said floor, said lens including third and fourth latching tabs engaging said second latching means for releasably coupling said lens to said inner housing.

13. A lamp assembly according to claim 1, wherein said first and second latching tabs are symmetrically disposed at opposite ends of said inner housing.

14. A lamp assembly according to claim 1, further comprising a generally planar layer of resilient material disposed upon said base and exhibiting a non-compressed thickness greater than the clearance between the surface of said base and said continuous wall for biasing said inner housing away from said outer housing.

15. A lamp assembly according to claim 1, wherein said continuous wall forms an elongate, generally rectangular box-like enclosure for receiving at least two standard dry cells therein, and further including partition means extending within said continuous wall to divide the area within said continuous wall into two portions, each of said portions for receiving a standard dry cell;

contact means disposed within said box-like enclosure including a first resilient contact for urging a standard cell toward said partition, the distance between said uncompressed resilient contact and the nearest surface of said partition being less than the height of the body of said standard dry cell and a second, fixed contact for abutting the center terminal of a standard cell;

an upstanding boss extending inwardly of said continuous wall and adjacent said second, fixed contact, said upstanding boss having an edge defining a plane spaced from said continuous wall a distance greater than the height of said fixed contact to prevent the base of a standard dry cell from making electrical connection with said fixed contact;

the edge of said boss being generally parallel to said partition means and being spaced therefrom by a distance at least equal to the height of the body of a standard cell, but less than the height of a standard dry cell including the center terminal thereof;

the thickness of said partition means being less than the height of which the center terminal extends above the body portion of a standard cell.

16. A lamp assembly according to claim 1, comprising two continuous wall means defining a pair of generally rectangular, substantially parallel box-like receptacles each for receiving a pair of series-connected standard dry cells.

17. A lamp assembly according to claim 16, wherein said latching tabs are symmetrically disposed to extend generally between and adjacent opposite ends of said battery boxes, said switch means being disposed between said parallel battery boxes, and said switch actuating means extending through one of said latching tabs.

18. A lamp assembly according to claim 17, further including a generally planar layer of resilient material disposed between said base and said continuous walls and exhibiting an uncompressed height greater than the clearance between said base and said walls for urging said outer housing and said inner housing apart.

19. A lamp assembly according to claim 18, further including partition means extending transversely within each of said battery boxes, each partition means defining an aperture for allowing the center terminal of a standard dry cell to extend therethrough;

said electrical contact means comprising a first resilient contact at one end of each battery box for bearing against the base of a standard dry cell to urge said standard cell toward the opposite end of said battery box, and a second, fixed contact opposing each of said first, resilient contact for abutting the center terminal of a standard cell;

the dimension between an uncompressed end of said first, resilient contact and said partition means being less than the height of the body of a standard dry cell;

at least one boss upstanding within each of said continuous wall means adjacent each fixed contact, said boss extending above said fixed contact a distance less than the height of a center terminal of a standard dry cell for preventing the planar bottom of a standard cell from making electrical connection with said fixed contact;

the distal edge of said boss being separated from said partition means by a dimension at least equal to the height of the body of a standard dry cell, and being less than the overall height of a standard dry cell including the center terminal thereof;

said partition having a transverse thickness no greater than the height of the center terminal above the body of a standard dry cell.

20. A lamp assembly according to claim 18, wherein said apertures in said shell are disposed at opposite ends of said outer housing and slidingly receive at least a portion of said latching tabs.

* * * * *